US009372047B2

(12) United States Patent
Cho

(10) Patent No.: US 9,372,047 B2
(45) Date of Patent: Jun. 21, 2016

(54) AIR GUN FIRING CONTROL DEVICE

(71) Applicant: Chao-Hsiung Cho, Taipei (TW)

(72) Inventor: Chao-Hsiung Cho, Taipei (TW)

( * ) Notice: Subject to any disclaimer, the term of this patent is extended or adjusted under 35 U.S.C. 154(b) by 0 days.

(21) Appl. No.: 14/553,323

(22) Filed: Nov. 25, 2014

(65) Prior Publication Data

US 2015/0308784 A1 Oct. 29, 2015

(30) Foreign Application Priority Data

Mar. 6, 2014 (TW) ..... 103107781 A

(51) Int. Cl.

| | |
|---|---|
| ***F41B 11/00*** | (2013.01) |
| ***F41A 19/00*** | (2006.01) |
| ***F41A 19/10*** | (2006.01) |
| ***F41B 11/70*** | (2013.01) |
| ***F41A 19/03*** | (2006.01) |

(52) U.S. Cl.

CPC ..... *F41B 11/70* (2013.01); *F41A 19/03* (2013.01); *F41A 19/10* (2013.01)

(58) Field of Classification Search

CPC ..... F41B 11/70; F41A 19/03; F41A 19/10
USPC ..... 124/31, 37, 71, 72, 73; 42/69.01
See application file for complete search history.

(56) References Cited

U.S. PATENT DOCUMENTS

| | | | | | |
|---|---|---|---|---|---|
| 3,236,154 | A * | 2/1966 | Iwashita | F41A 19/03 | 89/128 |
| 4,023,465 | A * | 5/1977 | Inskip | F41A 19/46 | 89/131 |
| 4,067,309 | A * | 1/1978 | Wohrstein | F41B 11/647 | 124/31 |
| 4,523,509 | A * | 6/1985 | Thevis | F41A 19/03 | 89/129.02 |
| 4,891,898 | A * | 1/1990 | Houseman | F41A 19/33 | 42/69.02 |
| 5,497,758 | A * | 3/1996 | Dobbins | F41B 11/62 | 124/71 |
| 5,722,383 | A * | 3/1998 | Tippmann, Sr. | F41B 11/53 | 124/48 |
| 5,852,891 | A * | 12/1998 | Onishi | F41A 19/17 | 42/69.01 |
| 5,857,280 | A * | 1/1999 | Jewell | F41A 19/45 | 42/69.03 |
| 6,302,092 | B1 * | 10/2001 | Juan | F41B 11/57 | 124/31 |
| 6,550,468 | B1 * | 4/2003 | Tippmann, Jr. | F41B 11/721 | 124/31 |
| 7,478,632 | B2 * | 1/2009 | Halmone | F41B 11/55 | 124/74 |
| 7,900,622 | B2 * | 3/2011 | Douglas | F41B 11/57 | 124/32 |
| 7,971,583 | B2 * | 7/2011 | Chu | F41B 11/57 | 124/32 |
| 8,033,276 | B1 * | 10/2011 | Gabrel | F41B 11/723 | 124/73 |
| 8,833,353 | B2 * | 9/2014 | Cho | F41B 11/70 | 124/73 |
| 9,091,501 | B2 * | 7/2015 | Pichler | F41A 19/17 | |
| 9,121,654 | B2 * | 9/2015 | Arnedo Vera | F41B 11/70 | |
| 2011/0226227 | A1 * | 9/2011 | Douglas | F41B 11/57 | 124/77 |
| 2012/0160226 | A1 * | 6/2012 | Cho | F41B 11/723 | 124/73 |
| 2013/0319389 | A1 * | 12/2013 | Cho | F41B 11/70 | 124/73 |
| 2015/0007804 | A1 * | 1/2015 | Tippmann, Jr. | F41B 11/722 | 124/73 |

* cited by examiner

*Primary Examiner* — Alexander Niconovich
(74) *Attorney, Agent, or Firm* — Muncy, Geissler, Olds & Lowe, P.C.

(57) ABSTRACT

Pressurized air from an air pressure bottle creates the firing motive force for game firearms. After accumulating sufficient pressure, the pressurized air is channeled to the gun chamber to achieve a firing objective. Using an application system for single firing, a purely mechanical firing control device is formed as an integral body to achieve single firing and continuous firing, and which is simply fitted with an auxiliary component to assist in achieving continuous firing. The auxiliary component is located in the swinging path of a cocking trigger. The select continuous firing clasp is pushed upward by the trigger and supports a jumping bar, which causes the jumping bar to lose its clasping retaining capacity on a firing tube to achieve a continuous firing operation.

6 Claims, 8 Drawing Sheets

AIR GUN FIRING CONTROL DEVICE

BACKGROUND OF THE INVENTION 1. (a) Field of the Invention

The present invention provides a purely mechanical firing control device, and more particularly uses an auxiliary control component to assist in achieving continuous firing control under a single firing operation mode as a basis.

2. (b) Description of the Prior Art

In general, firearms that use air pressure as the power source are used in air guns for game use, and the manufacturing cost is not high. However, after a long history of development, and under low cost conditions, the industry has also created realistic exteriors for the air guns and simulation of realistic operating modes, such as the ability to load bullets from a cartridge magazine, and shooting modes enabling single or continuous firing. The continuous firing mechanism of such designs generally uses a battery circuit operated electromechanical valve system to achieve a continuous firing frequency operation, and to operate under single firing control, another mechanical mode is used. For example, U.S. patent application Ser. No. 13/770,844, submitted by the applicant of the present invention, uses a purely mechanical action, the advantage of which is that it avoids the use of electric power, and there is no concern about the gun malfunctioning because of problems such as the electronic device being affected with damp, or being damaged due to vibration. And a purely mechanical fixed stress enables pressure accumulation between actual firing and prior to firing, thereby achieving a relatively high threshold pressure value. The simple use of the air pressure formed by the pressure element to implement purely mechanical interactive operation between components enables achieving the ability to use a variety of shooting modes.

SUMMARY OF THE INVENTION

The primary objective of the present invention lies in a device that uses a purely mechanical trigger unit to achieve controlling single firing and continuous firing modes. The device primarily comprises an auxiliary select continuous firing clasp simply and conveniently fitted in a single firing control system. After a limiting cam directs a shearing pressure surface of a trigger to rise, then the horizontal height position of a firing clasp increases, and the upper edge of the select continuous firing clasp causes the midriff of a jumping bar to shear across and correspondingly change the operating angular position of a jumping bar. The jumping bar is thus unable to fully intervene with a firing tube, and the firing tube is able to freely move back and forth, thereby achieving the objective of enabling purely mechanical firing control.

A further objective of the present invention lies in the structured trigger unit supported by a base and integrated into a single device, and which is able to be inserted into or assembled into the gun body, thereby facilitating assembly and disassembly for maintenance purposes.

The third objective of the invention lies in the select continuous firing clasp of the trigger unit being composed from the overlapping of at least two movable round pins. And the select continuous firing clasp is movable located in a settling groove defined in the base. Furthermore, the select continuous firing clasp uses point contacts and rolling motions between the outer circumferences of the two round pins and each structural member to significantly reduce working resistance.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
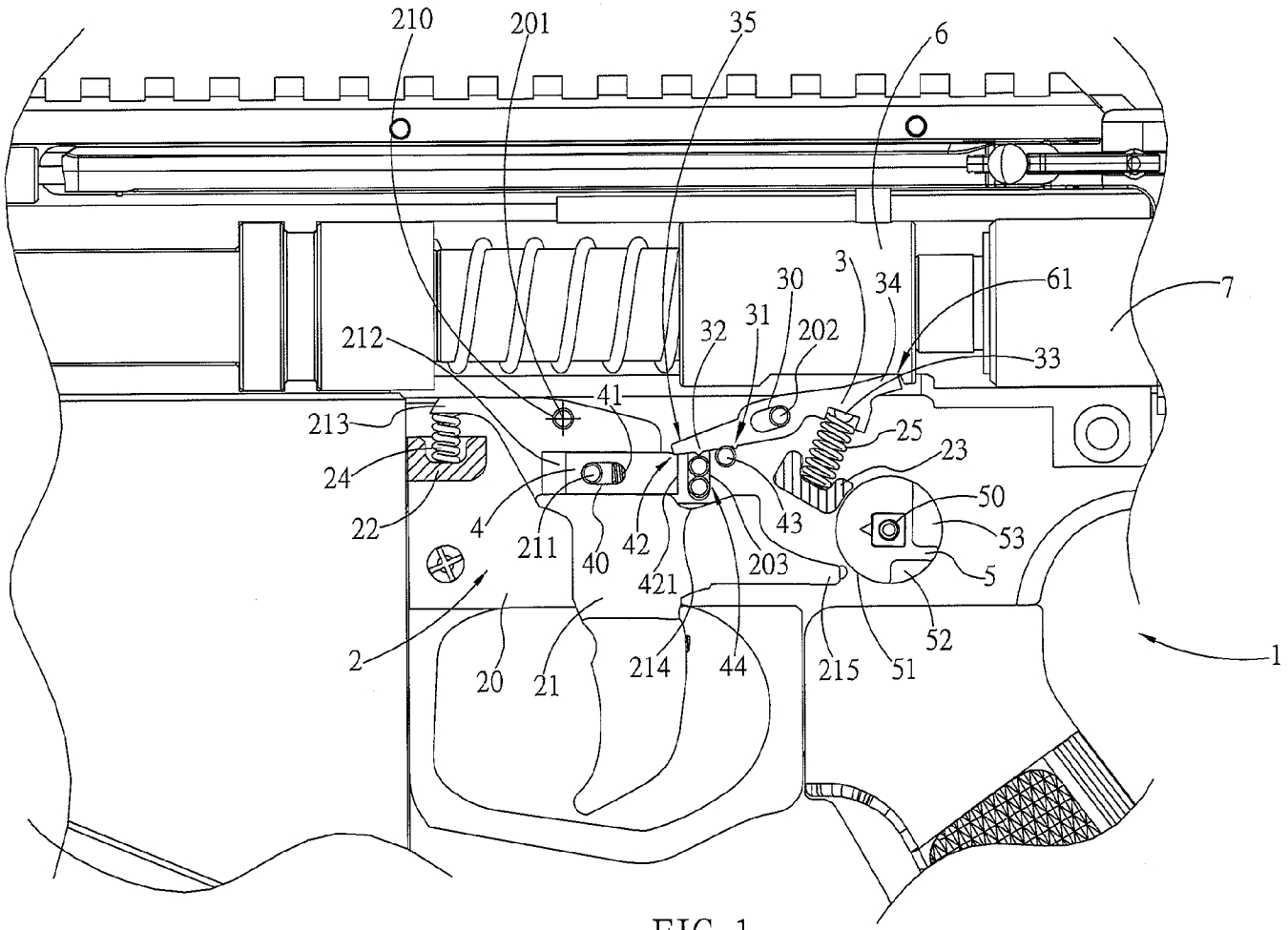
FIG. 1 is a system structure side view of each component of the device of the present invention.
Figure 2:
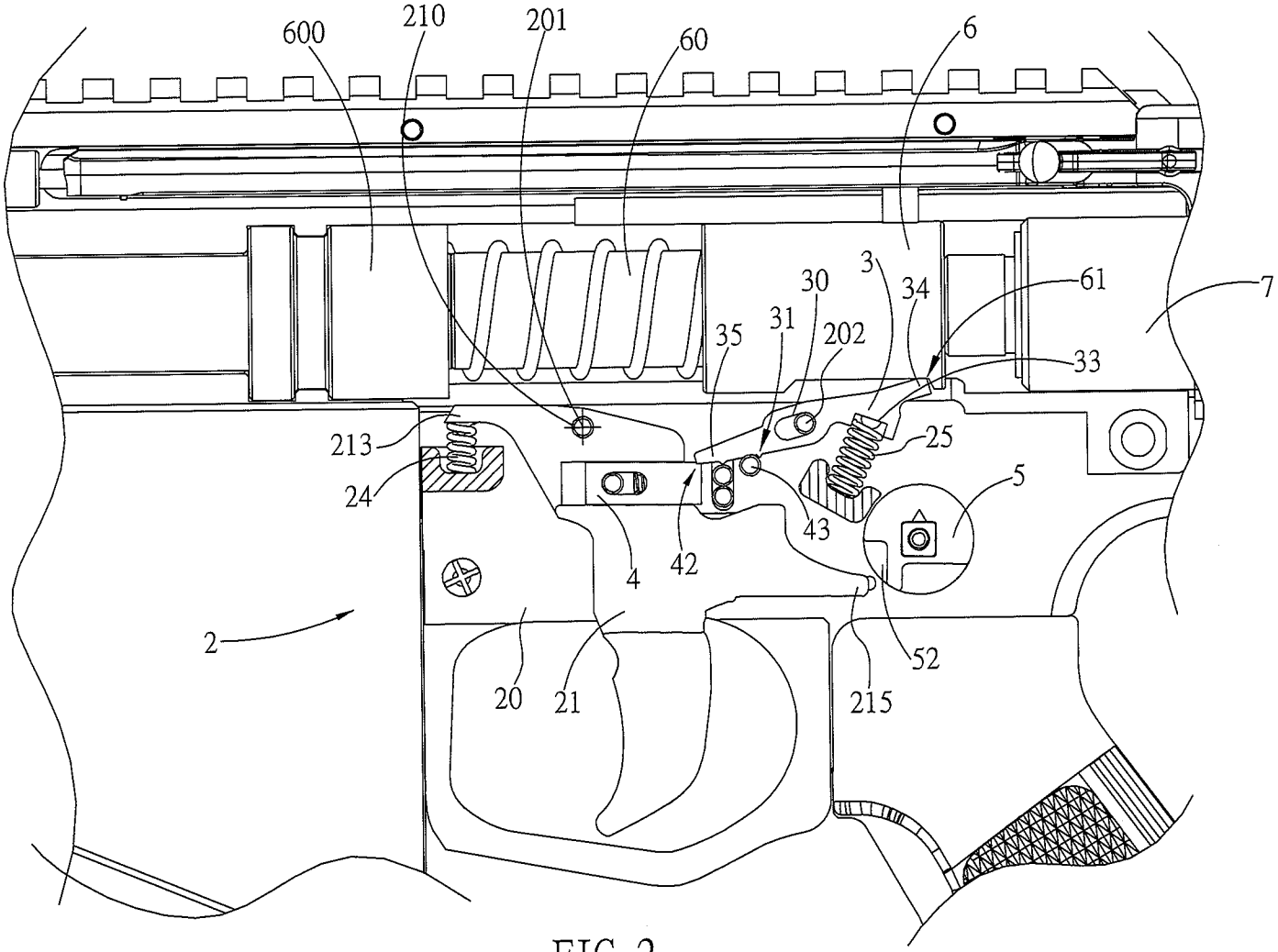
FIG. 2 is a side view of a preparatory operation mode showing the mechanism for loading a bullet into a chamber according to the device of the present invention.

Regarding the description of the operating mechanisms and operating states of the present invention, please refer to the description of the diagrams as follows:

Referring first to FIG. 1, The present invention provides a device for controlling the firing of a game air gun, and a firing control operating system of the present device is depicted in FIG. 1, wherein the inner structure of a gun body 1 is provided with a trigger unit 2, which is an assembly that is directly pieced together or uses an insertion method (which includes any type of cartridge concept, and thus not further detailed herein).

The trigger unit 2 is basically provided with a base 20, the interior system of which is connected with a trigger 21, as well as a jumping bar 3 and a limiting cam 5. A shaft hole 210 is provided within an area on the upper end of the trigger 21, and the shaft hole 210 enables a central shaft 201 of the base 20 to be movable pin joined to the trigger 21. Accordingly, after a user's finger cocks the trigger 21, the central shaft 201 is used as a central point to achieve a swinging, angular position movement. A press rod 213 extends from the upper end of the trigger toward the direction of the gun barrel. The press rod 213 compresses a reset spring 24, which is fixed by a spring base 22 joined to the front of the base 20, to achieve a swinging cocking motion using the central shaft 201 as a central point after the user's finger cocks the trigger 21, after which, the tension in the reset spring 24 is used to effect a resetting action.

The middle of the jumping bar 3 is provided with a longitudinal kidney shaped slide groove 30. A pivot round pin 202 joined to the base 20 is disposed to slide in the kidney shaped slide groove 30. The front end of the jumping bar 3 is provided with a nudging end 35, and the rear end is provided with a clasping end 34. The nudging end 35 and the clasping end 34 use the effect of the pivot round pin 202 to form a lever operating state. One side of the clasping end 34, positioned beneath the jumping bar 3, is provided with a coupling hole 33. The coupling hole 33 is arch opened by a push clamping spring 25 supported by a rear spring seat 23 fitted to the base 20, thereby enabling the normal state of the rear clasping end 34 to maintain an upward raised position.

The clasping end 34 forms a halting effect on a firing tube 6. During an inaction period, or before the firing tube 6 is preparing to fire, the clasping end 34 hooks onto a hook notch 61 indentedly provided at a corresponding position of the firing tube 6. When the clasping end 34 is hooked into the hook notch 61, longitudinal movement of the firing tube 6 is confined by the jumping bar 3. Under these circumstances whereby the firing tube 6 is restricted and inactive, the gun interior further receives and stores input of pressure through a right-hand side modulation device 7, thereby achieving a pressure accumulation function. Sufficient pressure accumulation meets the requirement to provide for later subsequent firing by achieving a relatively high firing threshold pressure. Hence, before each firing operation, the firing tube 6 must be temporarily fixedly held by the jumping bar 3; and even during a continuous firing operation, the firing tube 6 still requires to be temporarily held to meet the need to accumulate pressure.

The limiting cam 5 is fitted with a wheel shaft 50, and the wheel shaft 50 is movable assembled to the base 20. The limiting cam 5 can be turned to adjust the operating angular position thereof, wherein, turning adjustment of the limiting cam 5 is realized by, for example, adjusting the angle of a general safety toggle switch in a normal state on the outside of the gun body 1 through a shaft linkage relationship therewith. The angle selected from different angular positions can form a safety latch down, or a single firing mode, or a continuous firing mode, thereby enabling the user to select the firing operating mode required.

Regarding the systematic firing operation, after cocking the trigger 21, a compensatory angled end 42 configured on the trigger 21 causes the nudging end 35 at the front end of the jumping bar 3 to upwardly rise, whereupon, the clasping end 34 descends due to the pivot function of the pivot round pin 202. The descent of the clasping end 34 thus causes disengagement from the hook notch 61, thereby enabling the firing tube 6, replete with impingement pressure, to freely and rapidly displace forward to achieve a firing action.

In addition, regarding selection of an operating mode using the limiting cam 5, the facial structure of the wheel face of the limiting cam 5 is used to form an open state and restricted state corresponding to variation in angular displacement of a probe rod 215 fitted to the rear end of the trigger 21. And during the firing movement of the jumping bar 3, the kidney shaped slide groove 30 disposed to slide on the front end of the pivot round pin 202 is used to realize a position change to enable a back and forth movement and swinging action of the jumping bar 3. In particular, during the operating procedure for continuous firing, the midriff of the jumping bar 3 is pressed up against a single firing checking projection 43, and height limitation of the single firing checking projection 43 is used to enable the jumping bar 3, because of the tension of the push clamping spring 25, to avert the force of the pivot round pin 202 to enable the clasping end 34 of the jumping bar 3 to fixedly clasp the firing tube 6, thereby completing the preparation state prior to firing. Furthermore, the base 20 is fitted with an operation assisting select continuous firing clasp 44 corresponding to the midriff position of the jumping bar 3. The select continuous firing clasp 44 is pressed upward by the swinging arch action of the trigger 21, thereby lifting upward the top point of the select continuous firing clasp 44. And the horizontal height position of the top point enables midriff slide shearing of the nudging end 35 of the jumping bar 3, thereby causing the operating angular position of the jumping bar 3 to lose its halting capacity on the firing tube 6, and thus a continuous firing mode is formed.

During the continuous firing process, there must be a split-second pressure storing operation, during which time the push clamping spring 25 effects upward raising of the clasping end 34 of the jumping bar 3, which for a split-second fixedly clasps onto the hook notch 61, which causes split-second fixedly halting of the firing tube 6 for the pressure storing operation.

Although the push clamping spring 25 is able to fixedly clasp onto the hook notch 61, however, during continuous firing, the clasping angular position of the jumping bar 3 has almost descended to a horizontal position, thus, the fastening capacity thereof is subjected to the forward force of the firing tube 6. And after the jumping bar 3 is shifted toward the gun barrel, then the nudging end 35 at the front end of the jumping bar 3, because of the horizontal forward displacement, finally represses a buffer surface 421 of the compensatory angled end 42 of the trigger 21. In addition, the compensatory angled end 42 of the trigger 21 is formed on a cocking member 4 that is disposed to slide in a slide groove 212. The cocking member 4 is provided with a kidney shaped hole 40, and the kidney shaped hole 40 is disposed to slide on a stop rod 211 fixed to the trigger 21. Moreover, a spring 41 is fitted between the compensatory angled end 42 and the stop rod 211. The elastic arch force produced by the spring 41 in a normal state pushes against the cocking member 4 towards the right. When subjected to pressure from the nudging end 35, the cocking member 4 will yield toward the direction of the front end of the gun barrel, thereby enabling the nudging end 35 to overreach the buffer surface 421 of the compensatory angled end 42, and thus upwardly spring up and overreach the upper edge of the compensatory angled end 42. The lower edge of the nudging end 35 then shear presses the upper edge of the compensatory angled end 42 of the cocking member 4.

In the system structure, the jumping bar 3 is able to effect a halting operation that fixedly clasps the firing tube 6, which is similar to a general firearm design concept. And after the firing tube 6 withdraws, the lower hook notch 61 is retained by the clasping end 34 of the jumping bar 3. Moreover, the lower portion of the jumping bar 3 is subjected to the arched pressure of the push clamping spring 25, thus causing the jumping bar 3 to maintain a clasping angle. Furthermore, fixedly holding of the system structure by the pivot round pin 202 depends on the kidney shaped slide groove 30 of the jumping bar 3 achieving transient fixing thereof. Hence, on the basis of having sufficient accumulated pressure, the firing tube 6 will effect a frontward impulse pressure, whereupon the clasping end 34 of the jumping bar 3 is fixedly supported by the pivot round pin 202 in the kidney shaped slide groove 30 in the middle section of the gun body. The aforementioned pressure is then resisted by the pivot round pin 202 through the jumping bar 3 to achieve a clasping effect on the firing tube 6. The nudging end 35 of the jumping bar 3 rises when subjected to the compensatory angled end 42 of the trigger 21, whereupon a lever effect causes the clasping end 34 to descend and disengage from the push clasping of the hook notch 61, thereby enabling the firing tube 6 to freely proceed with firing.

In addition, the midriff of the nudging end 35 of the jumping bar 3 is provided with a V-shaped single firing latch 31 and a continuous firing latch 32 corresponding to shearing motion positions of the single firing checking projection 43 and the select continuous firing clasp 44, respectively; which enable the jumping bar 3 to shear across the single firing checking projection 43 or the top point of the select continuous firing clasp 44 during the process of a single firing operation or a continuous firing operation, respectively. Use of the heights of the single firing latch 31 and of the continuous firing latch 32 assist in increasing the descent height of the clasping end 34. And the V-shaped gradient forms an action similar to a cam to enable the clasping end 34 achieve split-second improvement in the operating curve of the descent speed of the clasping end 34 during the period of descent due to the assistance from the single firing latch 31 or the continuous firing latch 32.

The cross-section direction of the aforementioned select continuous firing clasp 44 must be disposed to allow sliding up and down in a settling groove 203 defined in the base 20. A basic requirement is that the upper and lower top points are arc curved surfaces to minimize frictional force on the shearing pressure surface 214 or the nudging end 35. And the height of the select continuous firing clasp 44 is further used as a guideline, and the overlapping of two cross-sections form a true circular round pin. Point contact relationships between the outer circumferences of the round pins and each component is used to lower working frictional force.

Referring to FIG. 1, regarding the firing mode and preposition control of the present device, a stop wheel surface 51 of the limiting cam 5 is selected, whereupon the wheel surface of the stop wheel surface 51 limits the activity space of the probe rod 215, which disables the trigger 21 from being activated and forms a static situation in the firearm to achieve a safety function.

Referring to FIGS. 2-5, regarding the single firing operating mode provided by the present device, the preparation modes of the trigger 21 of the trigger unit 2 and the jumping bar 3 are as depicted in FIG. 1. Because the body section of the jumping bar 3 receives the support of the pivot round pin 202 and causes the clasping end 34 to lock the firing tube 6, thus, the firing tube 6 is able to form a static state. Such a static state enables pressure from the modulation device 7 to be delivered and assist the interior of the firing tube 6 to form a continuous pressure effect. When firing, pressure in the firing tube 6 is channeled toward a gun barrel 600 through a firing pipe 60 to achieve firing of a bullet (the firing pipe 60 and the gun barrel 600 are general gun chamber designs, and thus not further detailed herein). During operation of a single shot, the user cocks the trigger 21, whereupon the trigger 21 uses the connection to the central shaft 201 as a central point to enable the probe rod 215 to form an upward arch swinging angular displacement. And when in a single firing mode, a single firing yield hole 52 of the limiting cam 5 aligns in the direction of the probe rod 215, and the indented space and upper edge of the single firing yield hole 52 is used to define the swinging of the probe rod 215 and limitation on the maximum height position thereof.

When cocking the trigger 21, the compensatory angled end 42 of the cocking member 4 provided on the trigger 21 is actuated, which causes upward nudging of the nudging end 35 of the jumping bar 3, and thus enables the jumping bar 3 to cause the clasping end 34 at the rear end thereof to descend using the pivot effect of the pivot round pin 202, thereby disengaging the clasping end 34 from clasping onto the hook notch 61, and enabling the firing tube 6 to achieve a firing frontward operation.

Figure 3:
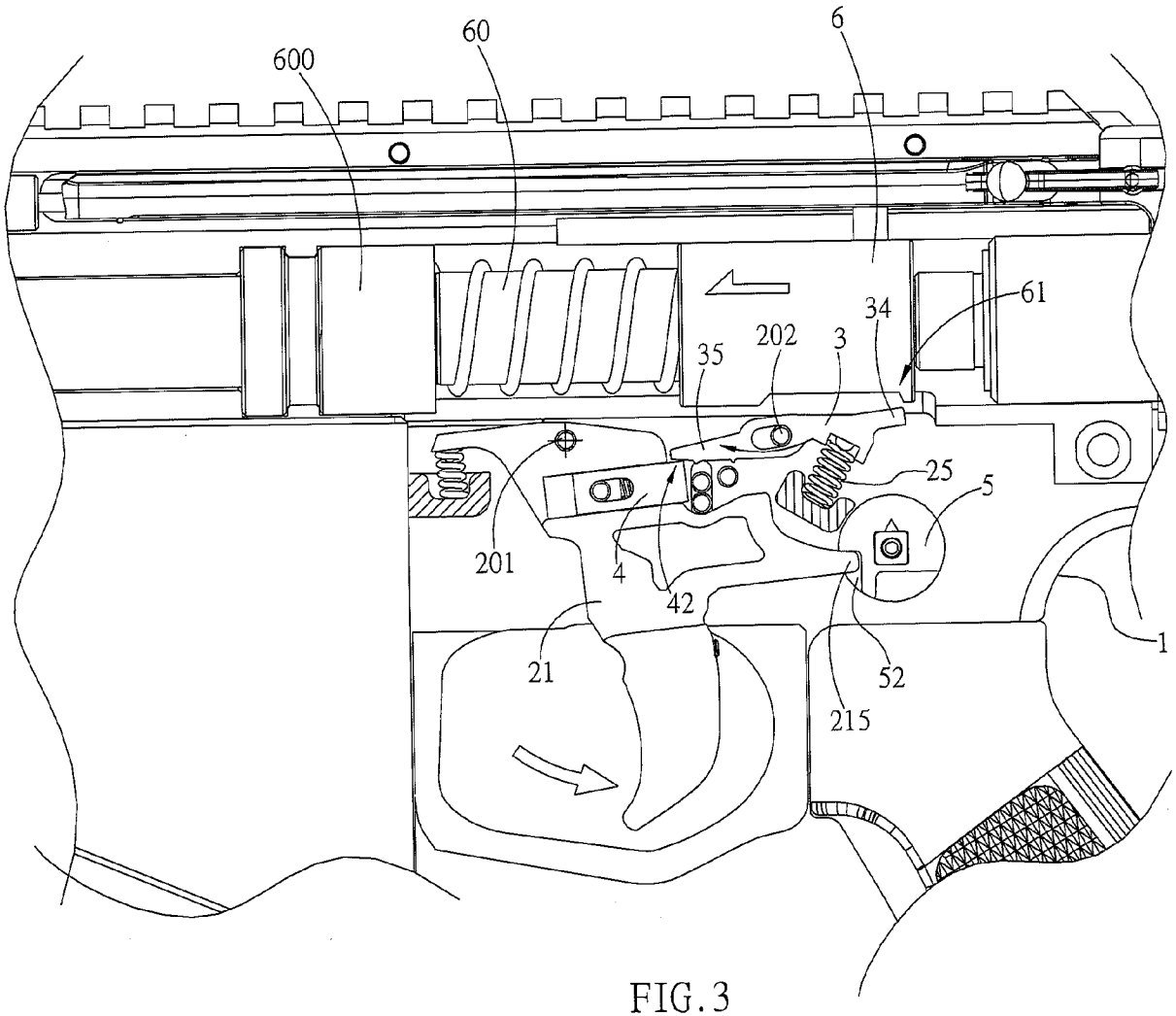
FIG. 3 is a side view of an angular position change in a jumping bar after triggering the firing of a bullet according to the device of the present invention.

Referring to FIG. 3, during the process of cocking the trigger 21, the trigger 21 uses the central shaft 201 as a central point to form a swinging mode, whereupon the probe rod 215 moves in the indented space of the single firing yield hole 52 and becomes limited by the upper edge of the single firing yield hole 52. The probe rod 215 thus becomes angular limited after swinging thereof, and such a restriction causes the compensatory angled end 42 to rise to a certain height. This raised height position causes the compensatory angled end 42 of the cocking member 4 to raise the nudging end 35, and also causes the jumping bar 3 to allow the clasping end 34 to descend using the pivot effect of the pivot round pin 202. At which time the clasping end 34 disengages from the hook notch 61 and forms a release effect, thus enabling the firing tube 6 to freely fire.

Figure 4:
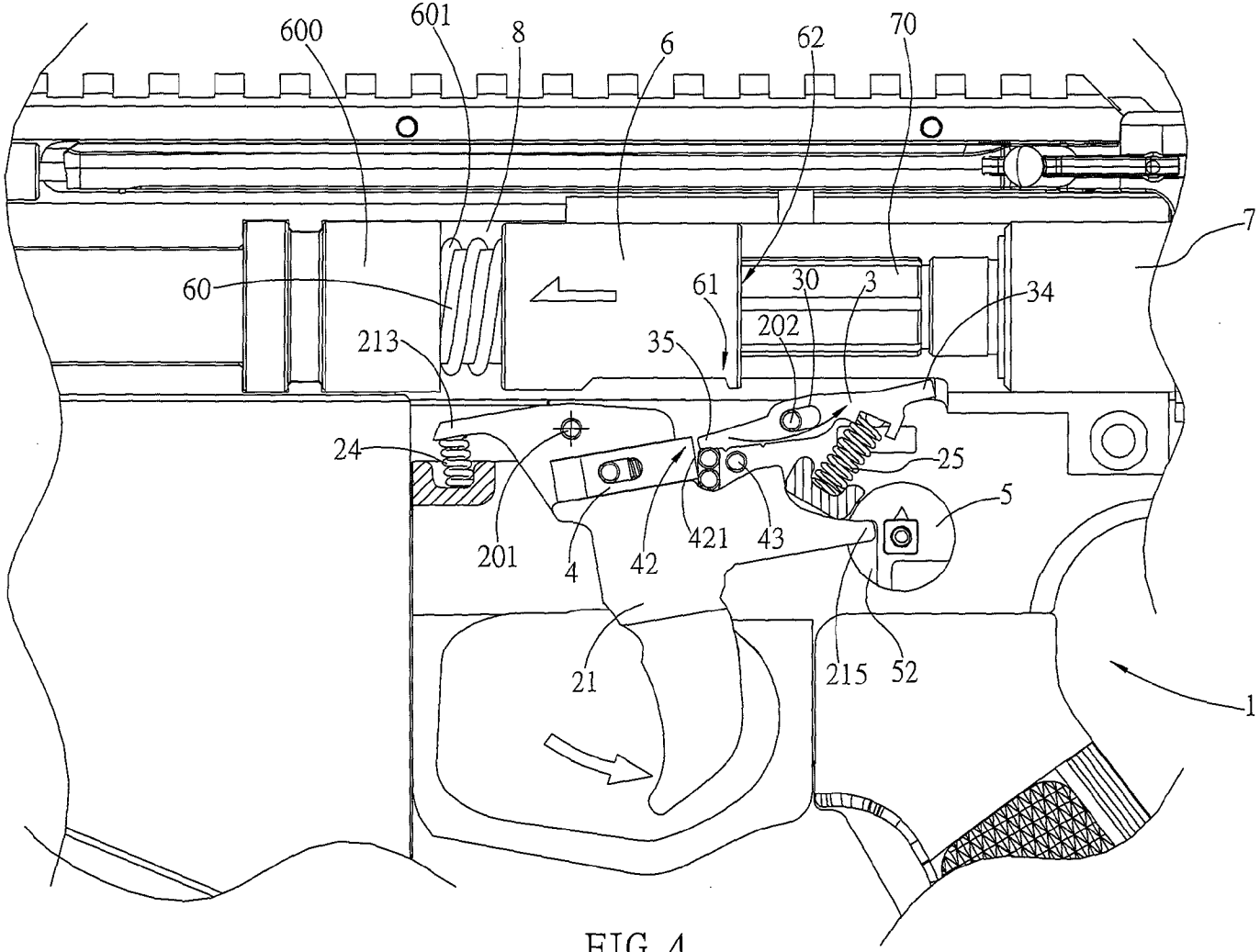
FIG. 4 is a schematic view of an angular position of the jumping bar reset after triggering the firing of a bullet according to the device of the present invention.

Referring to FIG. 4, the firing tube 6 is coaxially provided with the firing pipe 60, which is movably joined to the head of the gun barrel 600. In addition, the interior of the firing tube 6 forms a sliding cylinder 62, which is mounted so as to slide on a sliding column 70 coaxially extending from the modulation device 7 (see FIG. 4). And the firing tube 6 is axially disposed to slide in the interior of a propelling chamber 8 coaxially aligned with the gun barrel 600 of the gun body 1. After the firing tube 6 is fired toward the direction of the gun barrel 600, then the jumping bar 3 is subjected to the arched force of the push clamping spring 25, which causes the clasping end 34 to retreat backward and move upward to reset using the pivot round pin 202 as a central pivot. And a downward pressure is similarly formed on the nudging end 35 at the front end of the jumping bar 3 through the pivot effect of the pivot round pin 202. The downward pressure is limited by the height restriction of the single firing checking projection 43, causing the lengthwise body of the jumping bar 3 to assume a definite slanting angle. At which time the trigger 21 is subjected to an eccentric swinging angular position after cocking thereof, and in a split-second, the buffer surface 421 provided on the compensatory angled end 42 of the trigger 21 faces the end surface of the nudging end 35.

Figure 5:
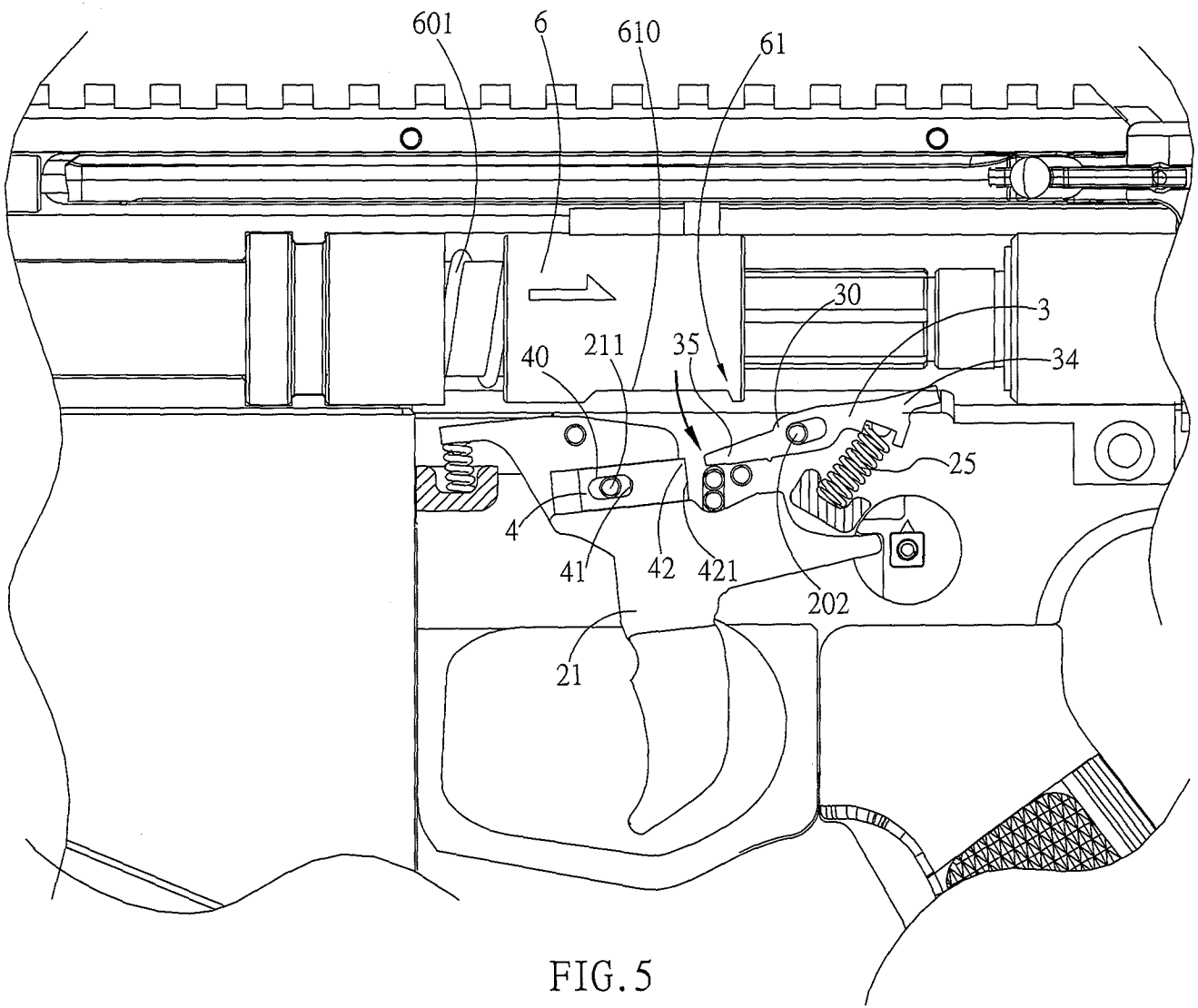
FIG. 5 is a schematic view of an angular position during the process of a firing tube resetting after triggering the firing of a bullet according to the device of the present invention.

Referring to FIG. 5, after firing, the jumping bar 3 is subjected to the restoring force of a pressure spring 601 and retreats backward, during which time the lower edge of the hook notch 61 shears over the upper surface of the jumping bar 3, especially the upper surface of the clasping end 34. During the push fastening process, the jumping bar 3 is subjected to the pivot effect of the pivot round pin 202 and overcomes the pressure of the push clamping spring 25, thereby enabling the jumping bar 3 to descend and upwardly jump in a split-second. Upward jumping of the jumping bar 3 enables locking into the hook notch 61, and at the time, because the trigger 21 has already been released, the compensatory angled end 42 has dropped below its horizontal position.

Prior to the firing tube 6 resetting, the jumping bar 3 is subjected to arched pressing of the push clamping spring 25, and the nudging end 35 falls downward using the pivot effect of the pivot round pin 202 to face the corresponding face of the buffer surface 421 of the cocking member 4 fitted to the trigger 21. During the process of backward resetting of the firing tube 6, after the hook notch 61 slides over the upper surface of the jumping bar 3, because of the further accumulation of pressure, a midriff plane surface 610 of the firing tube 6 shear slides over the angled end of the clasping end 34. After which the hook notch 61 produces a forward pulling force on the clasping end 34 of the jumping bar 3 which presses the nudging end 35 toward the buffer surface 421 of the cocking member 4. Furthermore, because the trigger 21 has been released, the compensatory angled end 42 of the cocking member 4 has also reset downward to a lower horizontal height, whereupon the nudging end 35 rubs over an angled end of the compensatory angled end 42, thereby causing a lower jaw edge of the nudging end 35 to further press up against the upper angled edge of the compensatory angled end 42 and cause the nudging end 35 to again reset on the top end of the compensatory angled end 42, see the preparation state before firing depicted in FIG. 2.

Regarding the continuous firing operation of the present device, basically the base 20 located at the operating position of the slide shearing path of the midriff of the jumping bar 3 is provided with the settling groove 203. The settling groove 203 enables the select continuous firing clasp 44 to be disposed and slide up and down therein (see FIG. 1). Moreover, the trigger 21 is indented with an upturned shearing pressure surface 214 corresponding to a lower edge position of the select continuous firing clasp 44. The shearing pressure surface 214 presses against and moves the bottom portion of the select continuous firing clasp 44, causing the select continuous firing clasp 44 to upwardly rise. The maximum height position of the rising is limited by the groove height of the settling groove 203. Such a height limitation causes the upper edge of the select continuous firing clasp 44 to be fixed at a certain height. The upper edge of the select continuous firing clasp 44 is a protruding curved surface which enables the midriff portion of the jumping bar 3 to slide over, thereby ensuring that the nudging end 35 of the jumping bar 3 does not go down.

Figure 6:
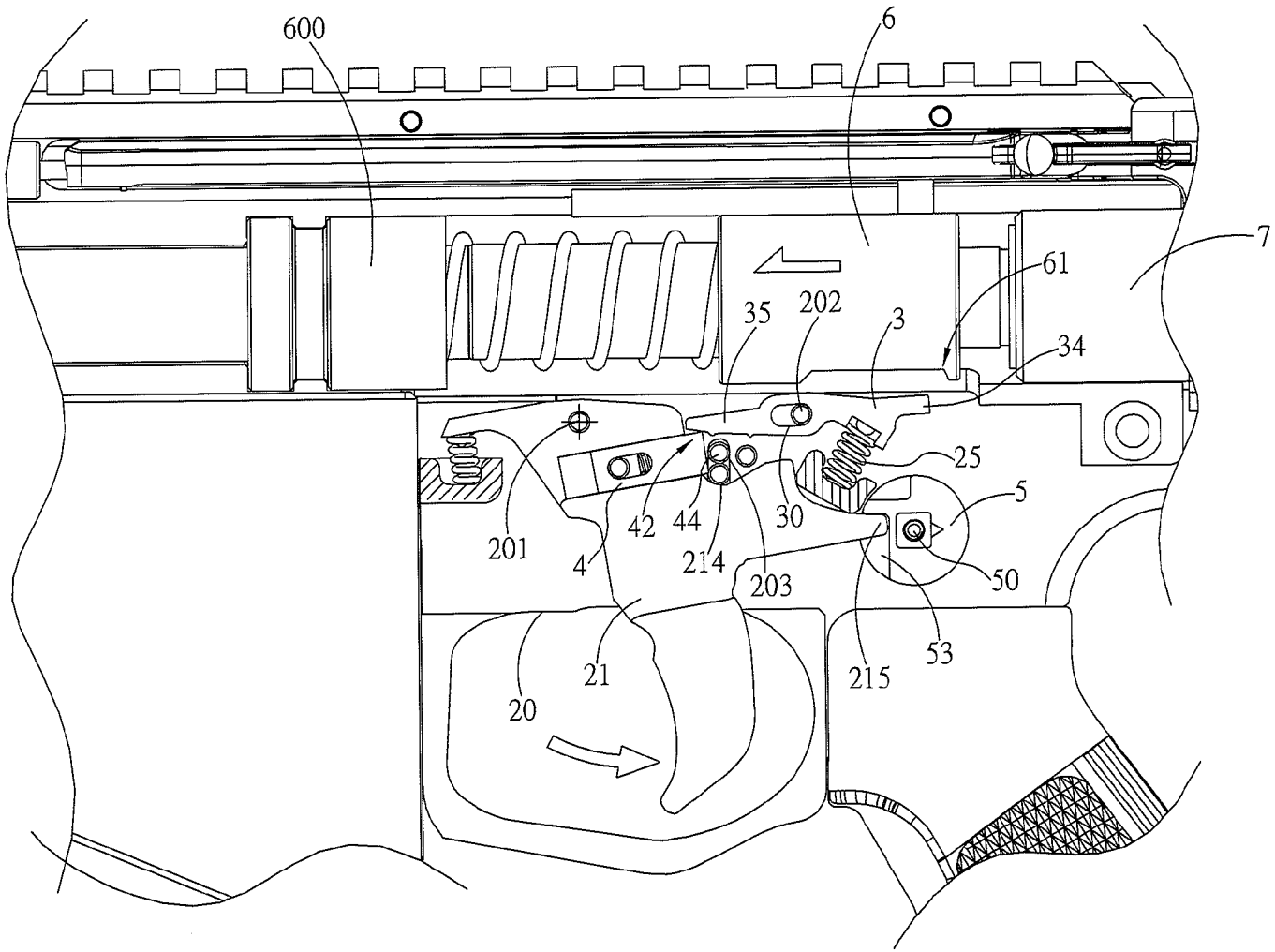
FIG. 6 is a schematic view of an operating angular position causing contact release of the jumping bar after triggering continuous firing according to the device of the present invention.

Regarding preparation prior to firing, the trigger 21 and the operating angular position of the jumping bar 3 are in the states shown in FIG. 1. As for a continuous firing operation, please refer to FIGS. 6~8. Referring first to FIG. 6, the operating mode for the limiting cam 5 is adjusted to be in the angular position for continuous firing, which enables a continuous firing yield hole 53 to face the direction of the probe rod 215. Using the central shaft 201 as a center point, the probe rod 215 upwardly swings after cocking the trigger 21, producing an angular displacement. The maximum height angular position of the probe rod 215 is impeded by the height of the upper edge of the continuous firing yield hole 53. During the first firing process, the compensatory angled end 42 of the trigger 21 is used to raise the nudging end 35 of the jumping bar 3, causing the clasping end 34 of the jumping bar 3 to disengage from the hook notch 61. At this time the firing tube 6 is freely displaced in the direction of the gun barrel 600, and fires the first bullet, while the finger of the user continues to pull the trigger 21.

Figure 7:
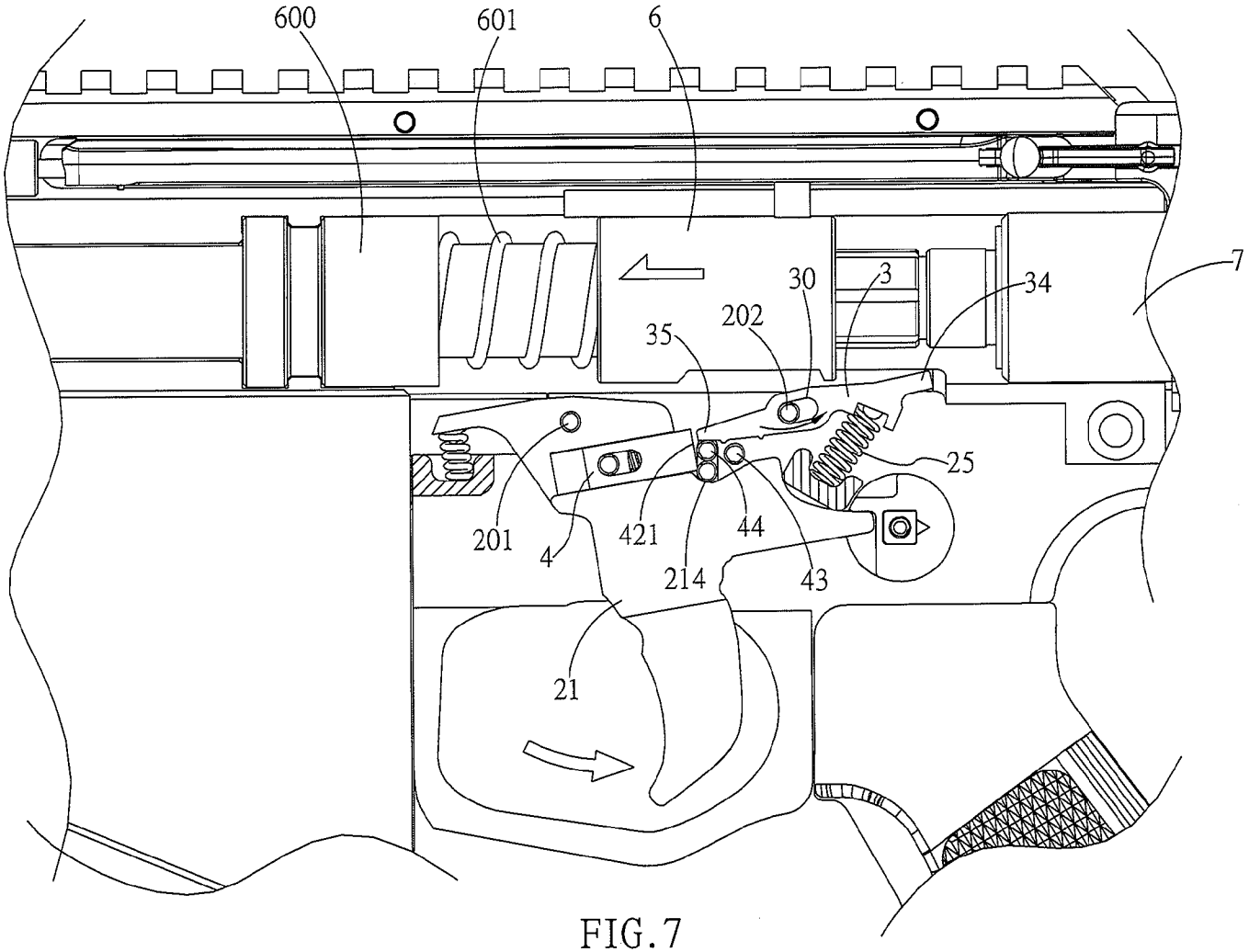
FIG. 7 is a schematic view depicting the process of the jumping bar resetting after triggering continuous firing according to the continuous of the present invention.
Figure 8:
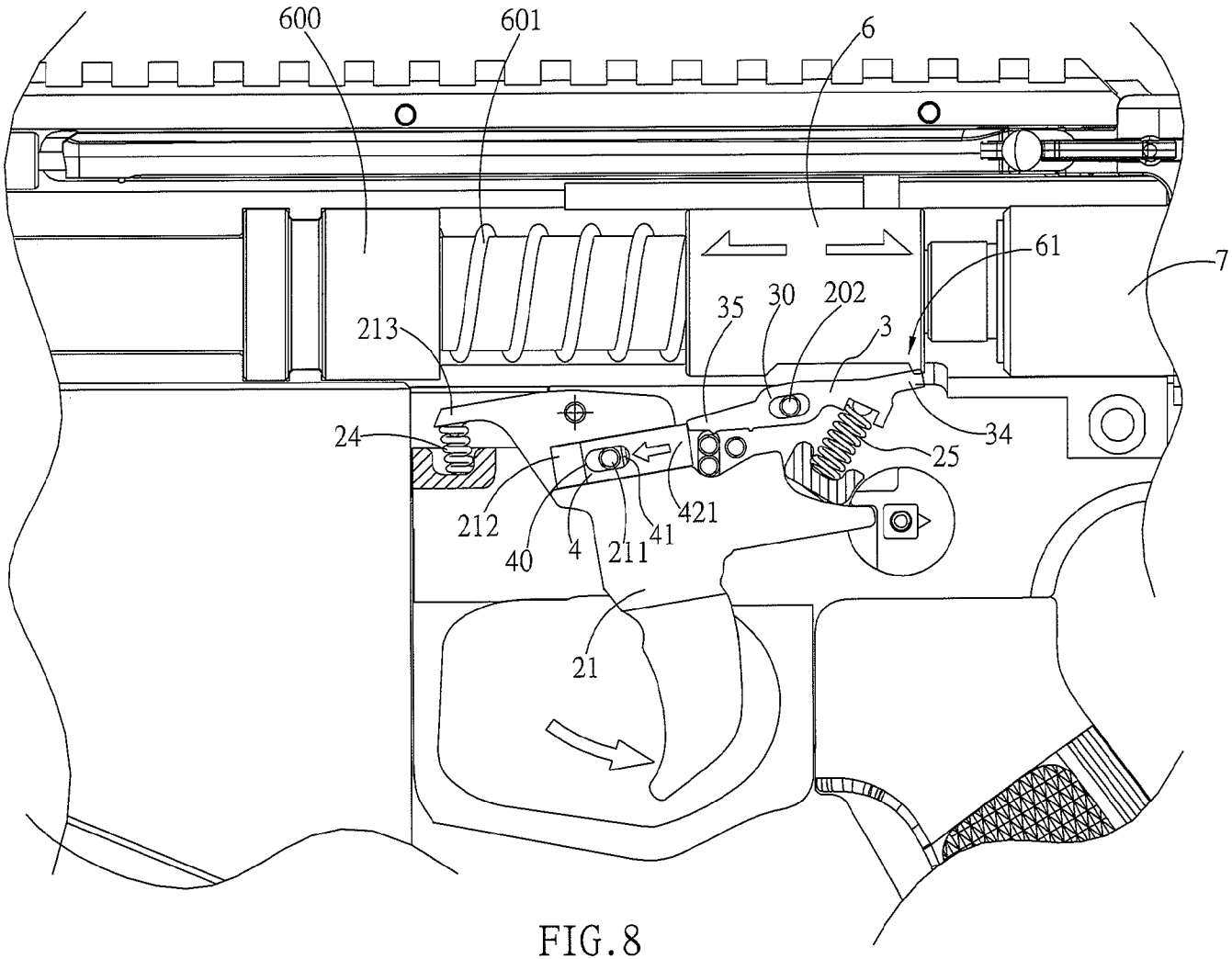
FIG. 8 is a schematic view of angular positions after the preceding return of the firing tube produces a clasping effect on the jumping bar after triggering continuous firing according to the device of the present invention.

Referring to FIGS. 7 and 8. After the firing tube 6 is displaced in the direction of the gun barrel 600, the clasping end 34 of the jumping bar 3 is subjected to the tension of the push clamping spring 25 and again resets rearward and upwardly. The reset angle of the clasping end 34 similarly depends on the pivot of the pivot round pin 202, and the midriff of the nudging end 35 presses the uppermost point of the select continuous firing clasp 44. Furthermore, the bottom end of the select continuous firing clasp 44 is subjected to continued shearing pressure from the shearing pressure surface 214 of the trigger 21, thereby stopping the select continuous firing clasp 44 from descending. At this time the front end of the nudging end 35 faces the buffer surface 421 of the jumping bar 3 of the trigger 21, and the midriff of the nudging end 35 is unable to descend and contact the upper end of the single firing checking projection 43. The push clamping spring 25 continues to arch press upward on the clasping end 34 of the jumping bar 3, and after the firing tube 6 fires, the clasping end 34 is subjected to the forced arched return of the pressure spring 601. During the return process, the downward protruding midriff of the hook notch 61 slides across the upper surface of the clasping end 34 and enables the clasping end 34 to achieve a transient retention of the hook notch 61. During this transient split-second of retention, the firing tube 6 is able to accumulate pressure from the pressure source of the modulation device 7. And after accumulating sufficient pressure, a reversal effect causes the hook notch 61 to pull the clasping end 34, whereupon an arched tension smaller than the forward shearing force of the firing tube 6 causes the firing tube 6 to fire again.

After completing pressure accumulation in the interior of the aforementioned firing tube 6, a forward force toward the gun barrel 600 is formed, and continuous firing uses all the pressure to enable the firing tube 6 to achieve a free forward force. First, the firing tube 6 is subjected to transient fixing by the clasping end 34, thereby enabling pressure to accumulate, which causes the pressure to rise. After the pressure has risen to a sufficient level, a reversal effect causes clasping of the clasping end 34 to effect forward displacement of the jumping bar 3, whereupon the kidney shaped slide groove 30 of the jumping bar 3 slides leftward and forward on the pivot round pin 202. During this sliding process, the nudging end 35 faces the buffer surface 421 of the cocking member 4 provided on the trigger 21. And when the clasping end 34 is retained by the hook notch 61, then the front end of the nudging end 35 presses on the surface of the buffer surface 421.

The buffer surface 421 is formed on the cocking member 4, furthermore, the slide groove 212 of the cocking member 4 is linear groove shaped, which provides displacement guidance for the cocking member 4. The kidney shaped hole 40 provided in the cocking member 4 is movable on the stop rod 211 fixed to the trigger 21, and the arched spring 41 is fitted between the stop rod 211 and the buffer surface 421. After the aforementioned nudging end 35 presses down on the buffer surface 421, contracted distortion of the spring 41 is used to yield a distance. Furthermore, at this time the buffer surface 421 forms an angle greater than 90 degrees with the pressure line of the nudging end 35, thereby enabling the nudging end 35 to face a further subsequent pressure effect due to the 90 degrees angle. Finally, the nudging end 35 jumps over the angled end of the compensatory angled end 42, and the operating state is restored to that depicted in FIG. 6. As for the operating state depicted in FIG. 6, the firing tube 6 is shown to be displacing leftward, after which the operating mode is as depicted in FIG. 7, wherein the push clamping spring 25 is used to upwardly raise and reset the clasping end 34 of the jumping bar 3. After the clasping end 34 has been raised, the operating state reverts back to that depicted in FIG. 8. During the rearward motion of the firing tube 6, the firing tube 6 presses over the clasping end 34 of the jumping bar 3, and a reversal effect enables the hook notch 61 to again clasp the clasping end 34, which causes forward displacement of the jumping bar 3. After forward displacement of the jumping bar 3, the nudging end 35 again presses over the compensatory angled end 42 of the cocking member 4, whereupon the clasping end 34 of the jumping bar 3 once again is released from the hook notch 61 of the firing tube 6, thereby achieving a continuous firing operation.

The continuous firing operation shown in the aforementioned FIGS. 6~8 primarily uses raising of the select continuous firing clasp 44 from shearing motion subjected by the shearing pressure surface 214 of the trigger 21 to enable a restoring angular relationship of the jumping bar 3 to first cause the push clamping spring 25 to effect a rearward and arched upward motion of the clasping end 34. The clasping end 34 is then further subjected to forward pulling by the firing tube 6 filled with accumulated pressure. At the same time the nudging end 35 of the jumping bar 3 approaches and contacts the elastic retractable compensatory angled end 42.

After contact, the lower jaw of the nudging end 35 shears over the buffer surface 421 of the compensatory angled end 42 toward the upper edge of the compensatory angled end 42 and jumps over the compensatory angled end 42. This jumping action uses the pivot effect of the pivot round pin 202 to enable the clasping end 34 of the jumping bar 3 to again disengage from the hook notch 61 of the firing tube 6. Repeating of the cyclic operation enables a continuous firing effect to be achieved, wherein the operation process primarily involves manipulating the slanting angular position variation of the jumping bar 3 to release retention of the firing tube 6, and thereby achieve purely mechanical continuous firing control.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An air gun firing control device, which uses a simple auxiliary method to enable a firing system to achieve multiple firing modes, and comprises:

a base, the base is provided with a central shaft connected to a trigger, a reset spring enables resetting the trigger, an upper side of the base is fitted with a rearward retractable cocking member, a rear-end upper angle of the cocking member is configured with a compensatory angled end; wherein the trigger is further provided with a probe rod that horizontally extends rearward, and a shearing pressure surface is provided between the cocking member and the probe rod;

a limiting cam, the limiting cam is pivotal disposed on a wheel shaft fixed to the base, a round surface of the limiting cam is provided with a stop wheel surface, the stop wheel surface is indented with a single firing yield hole, and the single firing yield hole assumes a 90 degrees position; wherein the limited cam is further provided with a continuous firing yield hole; the stop wheel surface, the single firing yield hole, and the continuous firing yield hole are respectively adjusted by the probe rod;

a jumping bar, a body section of the jumping bar is provided with a kidney shaped slide groove that is disposed and slided on a pivot round pin fixed to the base, a rear upper end of the jumping bar is a clasping end, a rear lower side of the jumping bar is provided with a coupling hole, and the coupling hole is supported by a push clamping spring fitted to the base, a front of the jumping bar is provided with a nudging end, and the nudging end retains the compensatory angled end of the trigger;

a single firing checking projection, the single firing checking projection is fixed to the base, an upper edge of the single firing checking projection supports the nudging end to enable the nudging end to clasp an upper edge of the compensatory angled end;

a settling groove, the settling groove is defined in main body of the base, and is located in a wiping path of the shearing pressure surface, a select continuous firing clasp, the select continuous firing clasp is installed in the settling groove using a movable disposed relationship, and is subjected to up and down displacement defined by the settling groove; a bottom edge of the select continuous firing clasp is subjected to upward pressing by the shearing pressure surface of the trigger, and a top point of the select continuous firing clasp enables back and forth sliding of a lower midriff portion of the nudging end of the jumping bar; after rising, a horizontal height position of the top point maintains the jumping bar in an almost horizontal angle, which enables continuous firing.

2. The air gun firing control device according to claim 1, wherein the base is formed as an integral body with a gun body.

3. The air gun firing control device according to claim 1, wherein the base is a single body, and forms an assemble and disassemble relationship with a gun body.

4. The air gun firing control device according to claim 1, wherein the select continuous firing clasp is formed from the overlapping of two support shaft type round pins.

5. The air gun firing control device according to claim 1, wherein the cocking member of the trigger is disposed to slide in the slide groove defined at a corresponding position of the trigger, the slide groove is provided with a stop rod that enables a single firing latch of the cocking member to be disposed and slide therein.

6. The air gun firing control device according to claim 1, wherein the lower midriff of the nudging end configured on the jumping bar is provided with a downward protruding V-shaped single firing latch and a continuous firing latch.

* * * * *